US009325125B2

(12) United States Patent
Fang et al.

(10) Patent No.: US 9,325,125 B2
(45) Date of Patent: Apr. 26, 2016

(54) ELECTRICAL CONNECTOR HAVING A CONTACT ARRANGEMENT TO IMPROVE THE QUALITY OF THE SIGNAL TRANSMISSION

(71) Applicant: Drapho Electronics Technology Co., Ltd., Kunshan, Jiangsu (CN)

(72) Inventors: Zhihong Fang, Jiangsu (CN); Zhuping Wu, Jiangsu (CN); Ming Zhang, Jiangsu (CN)

(73) Assignee: DRAPHO ELECTRONICS TECHNOLOGY CO., LTD., Kunshan, Jiangsu (CN)

( * ) Notice: Subject to any disclaimer, the term of this patent is extended or adjusted under 35 U.S.C. 154(b) by 121 days.

(21) Appl. No.: 14/282,932

(22) Filed: May 20, 2014

(65) Prior Publication Data

US 2015/0087184 A1 Mar. 26, 2015

(30) Foreign Application Priority Data

Sep. 26, 2013 (CN) ..... 2013 2 0596518 U

(51) Int. Cl.

| | |
|---|---|
| ***H01R 24/00*** | (2011.01) |
| ***H01R 33/00*** | (2006.01) |
| ***H01R 24/60*** | (2011.01) |
| ***H01R 13/6471*** | (2011.01) |
| *H01R 13/6581* | (2011.01) |

(52) U.S. Cl.

CPC ..... *H01R 24/60* (2013.01); *H01R 13/6471* (2013.01); *H01R 13/6581* (2013.01)

(58) Field of Classification Search

CPC ..... H01R 33/7628; H01R 23/7073; H01R 23/6873

USPC ..... 439/569, 660, 607.35, 607.4

See application file for complete search history.

(56) References Cited

U.S. PATENT DOCUMENTS

| | | | | | |
|---|---|---|---|---|---|
| 5,295,843 | A * | 3/1994 | Davis | H01R 13/26 | 439/108 |
| 5,785,557 | A * | 7/1998 | Davis | H01R 13/26 | 439/108 |
| 6,955,568 | B1 * | 10/2005 | Wu | H01R 13/506 | 439/607.01 |
| 7,771,237 | B2 * | 8/2010 | Lei | H01R 13/502 | 439/607.54 |
| 7,931,501 | B1 * | 4/2011 | Chiang | H01R 12/724 | 439/607.01 |
| 8,113,865 | B1 * | 2/2012 | Yang | H01R 13/4367 | 439/353 |
| 8,197,281 | B2 * | 6/2012 | Yang | H01R 4/023 | 439/499 |
| 8,591,265 | B2 * | 11/2013 | Huang | H01R 24/60 | 439/660 |
| 2008/0200058 | A1 * | 8/2008 | Tsai | H01R 13/6583 | 439/353 |

* cited by examiner

*Primary Examiner* — Hae Moon Hyeon

(74) *Attorney, Agent, or Firm* — Locke Lord LLP; Tim Tingkang Xia, Esq.

(57) ABSTRACT

An electrical connector includes an insulating housing and a plurality of contacts retained on a mating portion of the housing. The mating portion has a mating port with a geometric centre. The contacts are divided into an upper array and a lower array. Each array includes several first contacts and at least one pair of second contacts located on two sides of the first contacts, the first contacts of the upper array are centrally symmetric to the first contacts of the lower array relative to the geometric centre of the mating port. The new type of contacts arrangement can improve the quality of the signal transmission.

11 Claims, 2 Drawing Sheets

ELECTRICAL CONNECTOR HAVING A CONTACT ARRANGEMENT TO IMPROVE THE QUALITY OF THE SIGNAL TRANSMISSION

CROSS-REFERENCE TO RELATED APPLICATIONS

This application claims priority under 35 U.S.C. §119 to People's Republic of China Patent Application 201320596518.7 entitled "Electrical connector" filed Sep. 26, 2013.

FIELD OF THE INVENTION

The present invention relates generally to electrical connection, and more particularly to electrical connectors.

BACKGROUND

Nowadays, in an electrical device, electrical connectors are regarded as very important components which directly affect on the stability and convenience of the electrical device. An electrical connector is normally used for electrical connection so that the electrical signal can be transmitted from one electrical component to another, thus, electrical connectors are widely used in kinds of electrical devices, such as computers, mobile phones, digital cameras, TV etc. which contains connectors like Universal Serial Bus (USB) connector, High Definition Multimedia Interface (HDMI) connector, RJ-45 connector etc.

Traditionally, an electrical connector normally includes an insulating housing and a plurality of terminals retained in the insulating housing. In order to improve the quality of signal transmission, said electrical connector may further includes a metal shell which covers on said insulating housing to realize Electromagnetic Interference (EMI) Shielding, but said metal shell fails to shield the signal interference between two adjacent terminals inside of the metal shell. So it is necessary to change the arrangement of the terminals to solve the problem of signal interference like cross-talk. In a traditional electrical connector, each terminal is arranged one by one in a same pitch inside the insulating housing, however, this arrangement is suitable for transmitting only one type of signal, in some condition, the terminals need to transmit different types of signals, thus, in order to reduce the cross-talk between the terminals, the arrangement of the terminals should be modified, that means the traditional terminal arrangement with a same pitch may not meet the requirement.

Thus, it is necessary to provide a new type electrical connector to solve the problems mentioned above.

SUMMARY OF THE INVENTION

Accordingly, an object of the present invention is to provide an electrical connector with a new type of contacts arrangement to improve the quality of the signal transmission.

In order to achieve the object set forth, an electrical connector in accordance with the present invention comprises an insulating housing including a mating portion with a mating port, said mating port having a geometric centre; a plurality of contacts retained on said mating portion and including an upper array and a lower array; wherein each array includes several first contacts and at least one pair of second contacts located on two sides of said first contacts, said first contacts of the upper array are centrally symmetric to the first contacts of the lower array relative to said geometric centre of the mating port.

Other objects, advantages and novel features of the invention will become more apparent from the following detailed description when taken in conjunction with the accompanying drawings.

DETAILED DESCRIPTION

Reference will now be made in detail to the preferred embodiment of the present invention.

Figure 1:
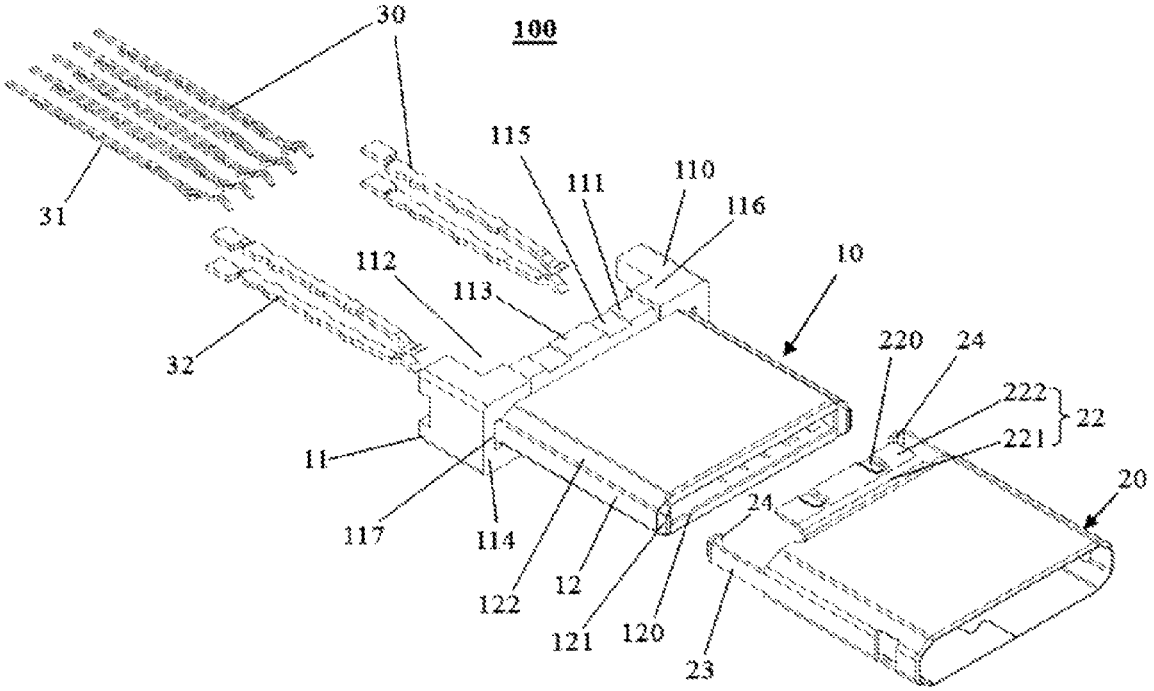
FIG. 1 is an exploded, perspective view of an electrical connector of the present invention.
Figure 2:
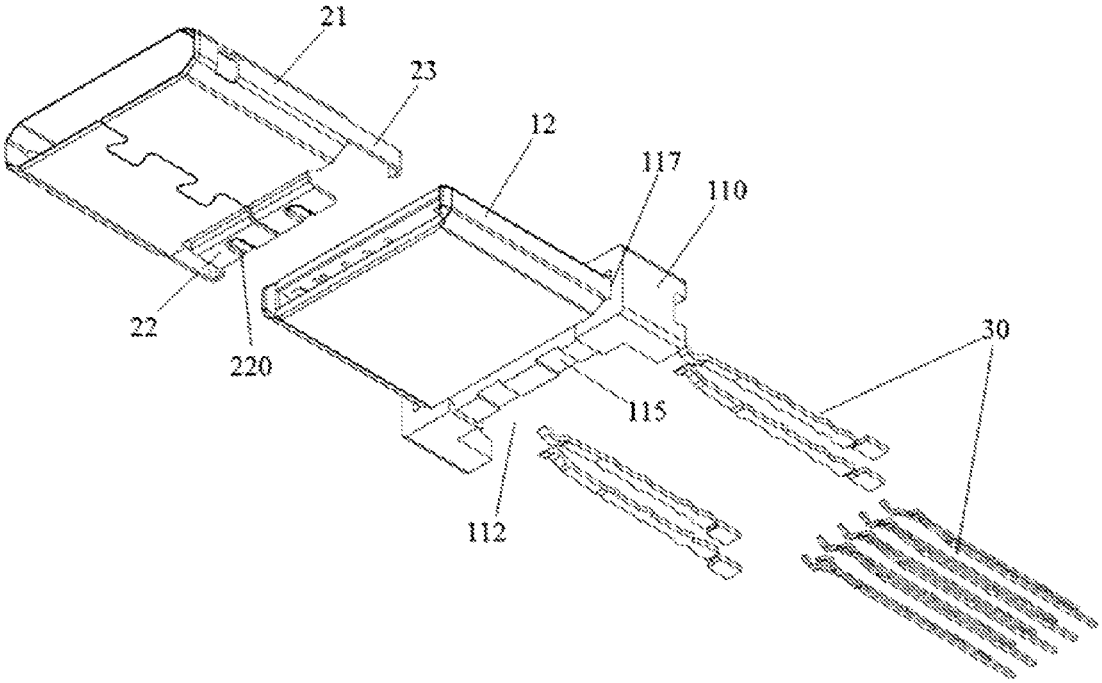
FIG. 2 is another perspective view of the electrical connector of the present invention.
Figure 3:
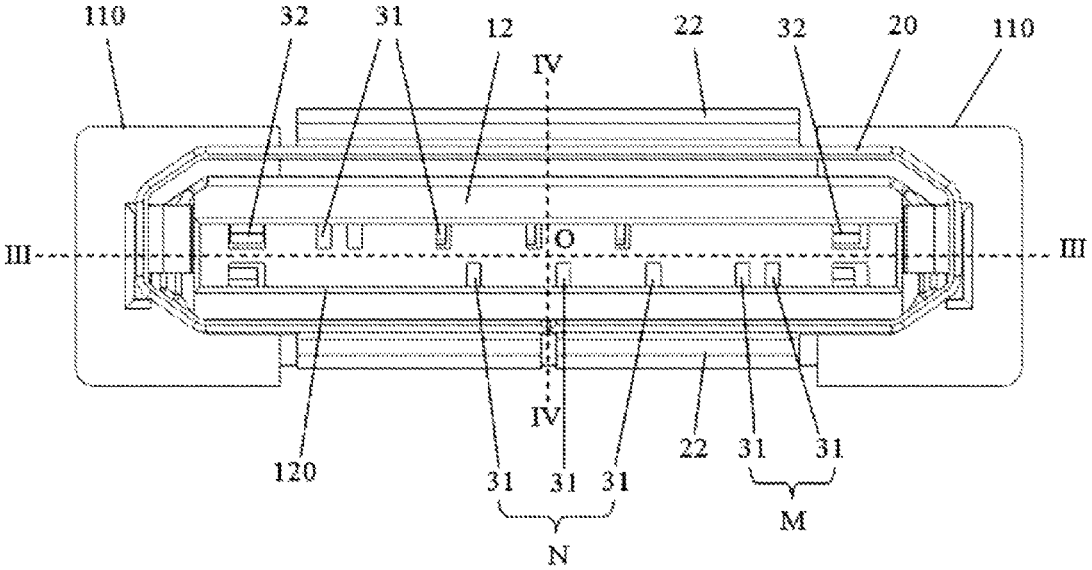
FIG. 3 is a front view of the electrical connector of the present invention.

As referring to FIG. 1 to FIG. 3, the present invention provides an electrical connector 100. The electrical connector 100 includes an insulating housing 10, a shell 20 retained on said insulating housing 10, and a plurality of contacts 30 received in said insulating housing 10. Said electrical connector 100 is used for mating with a coupled electrical connector (not shown) along a mating direction to realize signal transmission.

Said insulating housing includes a base portion 11 and a mating portion 12 extending from said base portion 11. Said base portion 11 has a pair of flange portions 110 and a connecting beam 111, said flange portions 110 protrude rearward beyond said connecting beam 111 to define a notch 112 formed between said flange portions 110 and connecting beam 111. Said connecting beam 111 defines a top surface 113 and a front surface 114, said top surface 113 of the connecting beam 111 is lower than a top surface 116 of said flange portion 110 and defines at least one concave portion 115 thereon. There is an inserting slot 117 formed between said flange portion 110 and the mating portion 12. Said mating portion 12 has a rectangular mating port 120 and a pair of guiding portions 121 formed on two sides of said mating port 120 so that a coupled connector can smoothly insert into the insulating housing 10. Moreover, said mating port 120 has a geometric centre O which is a crossover point of a horizontal centre line III and a vertical centre line IV. Said mating portion 112 further has a pair of slanted surface 122 on two lateral sides.

Said shell 20 is mounted on said insulating housing 10 and includes a main portion 21 and a retaining portion extending rearward from said main portion 21. Said retaining portion includes a pair of retaining plates 22 extending respectively from an upper side and a lower side of said main portion 21, and a pair of locking arms 23 extending from a right said and a left side of said main portion 21. Said locking arm 23 extends horizontally and defines a hooked tail 24 for inserting into said inserting slot 117 and hooking on a backside of the insulating housing 10 so that the shell may engage with the insulating housing 10 along the mating direction firmly. Said retaining plate 22 has at least one protruding 220 engaging with said concave portion 115. Said protruding 220 is formed on a top surface of said retaining plate 22 and downwardly protrudes toward said concave portion 115. Furthermore, said retaining plate 22 includes a slanted portion 221 and a horizontal portion 222, said protruding 220 is formed on said horizontal portion 222, said slanted portion 221 connects with said main portion 21.

Said shell 20 can firmly retain on said insulating housing 10 by said locking arms 23 and said retaining plates 22. As the top surface 113 of the connecting beam 111 is lower than the top surface 116 of said flange portion 110, said retaining plates 22 are located between said two flange portions 110 to engage with said connecting beam 111.

As shown in FIG. 3, said contacts 30 are assembled into said insulating housing 10 from a backside and retained on said mating portion 12 to mate with a coupled electrical connector. Particularly, said contacts 30 are divide into two arrays which are not symmetrical. Said two arrays include an upper array and a lower array which are respectively retained on two sides of said mating portion 12. Each array includes a plurality of first contacts 31 and a pair of second contacts 32. Said first contact 31 are signal contacts, said second contacts 32 are power contacts which are located on two sides of the first contacts 31. The arrangement of said upper array and lower array are centrally symmetric to each other relative to said geometric centre O of the mating port 120. The first contacts 31 are divided into two groups which includes a first group M and second group N, said first group M is far away from said geometric centre O while said second group N is closer to the geometric centre O. Said first group M includes at least two first contacts 31, said second group N includes at least three first contacts 31. Moreover, the pitch of two adjacent first contacts of the first group M is smaller than the pitch of two adjacent first contacts of the second group N. Such kind of arrangement may meet requirements of some special conditions, and said first group M and second group N can be used for transmitting two different types of signals, as the first group M is separated to the second group N, the influence therebetween may be reduced. The locations of the second contacts 32 in said upper array are symmetric with the locations of the second contacts 32 in said lower array along said horizontal centre line III.

To sum up, the electrical connector of the present invention 100 provides a new arrangement of the contacts which can meet requirements of different conditions and reduce the influence between the contacts inside of the shell 20.

The preceding description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the following claims and the principles and novel features disclosed herein.

What is claimed is:

1. An electrical connector, comprising:

an insulating housing including a mating portion with a mating port, said mating port having a geometric centre;

a plurality of contacts retained on said mating portion and divided into an upper array and a lower array;

wherein each array includes several first contacts and at least one pair of second contacts located on two sides of said first contacts, said first contacts of the upper array are centrally symmetric to the first contacts of the lower array relative to said geometric centre of the mating port;

wherein said first contacts are signal contacts, said second contacts are power contacts; and wherein the first contacts of each array are divided into two groups which includes a first group far away from said geometric centre and a second group closer to the geometric centre.

2. The electrical connector according to claim 1, wherein the pitch between two adjacent first contacts in said first group is smaller than the pitch between two adjacent first contacts in second group.

3. The electrical connector according to claim 2, wherein said first group includes at least two first contacts, said second group includes at least three first contacts.

4. The electrical connector according to claim 3, wherein said geometric centre is a crossover point of a horizontal centre line and a vertical centre line of the mating port, the second contacts in said upper array are symmetric with the second contacts in said lower array along said horizontal centre line.

5. The electrical connector according to claim 1, wherein said electrical connector further includes a shell covering on said insulating housing, said shell has a main portion and a retaining portion extending rearward from said main portion, the retaining portion includes a pair of retaining plates respectively extending from an upper side and a lower side of said main portion, and a pair of locking arms extending from a right side and a left side of said main portion.

6. The electrical connector according to claim 5, wherein said insulating housing includes a base portion, said base portion has a pair of flange portions and a connecting beam connecting with said flange portions, said connecting beam has a top surface and a front surface, the top surface defines a concave portion, the retaining plate engages with said concave portion of said connecting beam.

7. The electrical connector according to claim 6, wherein said retaining plate includes at least one protruding which engages into said concave portion, said protruding extends downwardly from a bottom surface of the retaining plate.

8. The electrical connector according to claim 7, wherein said retaining plate includes a slanted portion and a horizontal portion, said protruding is formed on said horizontal portion, and the slanted portion connects with the main portion.

9. The electrical connector according to claim 7, wherein said locking arm extends horizontally and has a hooked tail.

10. The electrical connector according to claim 9, wherein an inserting slot is formed between said flange portion and said mating portion for receiving said locking arm.

11. The electrical connector according to claim 10, wherein said top surface of the connecting beam is lower than a top surface of the flange portion.

* * * * *